United States Patent [19]

Tottori

[11] 4,001,636

[45] Jan. 4, 1977

[54] AC DRIVE DISCHARGE TYPE DISPLAY APPARATUS

[75] Inventor: Hiroshi Tottori, Amagasaki, Japan

[73] Assignee: Mitsubishi Denki Kabushiki Kaisha, Tokyo, Japan

[22] Filed: Oct. 15, 1974

[21] Appl. No.: 514,787

[30] Foreign Application Priority Data

Oct. 16, 1973 Japan ..... 48-116192

[52] U.S. Cl. ..... 315/169 TV; 315/169 R

[51] Int. Cl.[2] ..... H05B 37/00

[58] Field of Search ..... 315/169 TV, 169 R

[56] References Cited

UNITED STATES PATENTS

| | | | |
|---|---|---|---|
| 3,611,296 | 10/1971 | Johnson | 330/169 R X |
| 3,852,609 | 12/1974 | Peters | 330/169 TV |

*Primary Examiner*—Robert Segal
*Assistant Examiner*—Lawrence J. Dahl
*Attorney, Agent, or Firm*—Oblon, Fisher, Spivak, McClelland & Maier

[57] ABSTRACT

An AC drive type display apparatus including a display panel having groups of transverse electrodes and vertical electrodes which are disposed in cross form across a discharge gap and having cross points which are made luminescent by applying an AC sustaining drive voltage, a turn-on signal and turn-off signal. A drive circuit including transistors dispoed in a matrix is provided and has means for commonly connecting the emitters or bases of the transistors in each transverse line of the matrix and means for connecting the emitters or the bases which are commonly connected, through a first diode to a sustaining drive source. A first selective switch circuit for applying the turn-on signal or the turn-off signal by selectively driving the transverse line by connecting it to the emitters or the bases which are commonly connected is provided and means are provided for commonly connecting the bases or the emitters in each vertical line of the matrix. A means for connecting the bases or the emitters which are commonly connected, through a second diode to the sustaining drive source are provided and a second selective switch circuit for selecting the vertical lines which are commonly connected is provided wherein the collectors of the transistors of the drive circuit are connected to the electrodes in one or both of the groups of the electrodes in the transverse and the vertical direction of the display panel.

2 Claims, 20 Drawing Figures

AC DRIVE DISCHARGE TYPE DISPLAY APPARATUS

BACKGROUND OF THE INVENTION

1. Field of the Invention

The present invention relates in general to an AC drive type display apparatus and more particularly to an AC drive type display apparatus having a drive circuit for applying a sustaining drive voltage, a turn-on pulse and a turn-off pulse to a matrix type display panel.

2. Description of the Prior Art

A plasma display is a display panel utilizing a gas discharge phenomenon. In the display, a plurality of electrodes are faced through a discharge gap to make picture elements at the cross points, and desirable picture elements corresponding to the picture signal or the original picture are respectively made luminous to display the picture. It has been proposed to provide an AC drive system for the discharge display panel. In the system, an AC sustaining drive voltage is applied to desirable picture elements (usually all of picture elements are in a normal state) and a suitable turn-on pulse is applied to the picture elements which will be made luminous at the time for imparting luminescent dots, and a suitable turn-off pulse is applied to them at the time for extinction.

The AC sustaining drive voltage has a peak (crest) value which is lower than the discharge initiation voltage of the picture elements. When the AC sustaining drive voltage is always applied, it is possible to provide intermittent repeating luminescences during the time from the application of the turn-on pulse to the application of the turn-off pulse. This is referred to as a memory function which is a characteristic of the drive system.

FIG. 1 is a plane view of a display panel of a plasma display; and FIG. 2 is a sectional view taken along the line II—II of FIG. 1. FIG. 11 is a partial broken schematic view of a display panel. The display panel is generally designated by the reference numeral 1, and includes a lower substrate 10, an upper substrate 20 and a middle substrate 30 therebetween. The lower substrate 10 has a rectangular plate 12 made of a transparent insulator, such as a glass plate. A first group of electrodes (drive lines) 14 are disposed on one surface of the plate 12 and are composed of a plurality of fine electrodes.

The electrodes which are linear are disposed in parallel with substantially equal spaces to each other in a longitudinal direction, as shown in FIG. 1. The first group of electrodes 14 are covered with a transparent insulating plate 16 at all parts except both of the end parts.

The plate 16 can be a glass plate and has a plurality of linear grooves for fitting the electrodes on the surface faced to the plate 12.

The surface 16a (FIG. 2) of the plate 16 opposite to the plate 12 is a flat surface.

The upper substrate 20 has a structure similar to the lower substrate 10, and has a rectangular plate 22 made of a transparent insulator, such as glass. A second group of electrodes (drive lines) 24 are disposed on one surface of the plate and are composed of a plurality of fine electrodes.

The electrodes which are also linear are disposed in parallel with substantially equal spaces to each other in a longitudinal direction as shown in FIG. 1. The second group of electrodes 24 are also covered with a transparent insulating plate 26 such as a glass plate at all parts except both of the end parts. A plurality of linear grooves are provided for fitting the electrodes on the surface faced to the plate 22. The surface 26A (FIG. 2) of the plate 26 opposite to the plate 22 is a flat surface.

The lower substrate 10 and the upper substrate 20 are assembled into the panel with the middle substrate 30 between them, wherein the longitudinal directions of the plates 12 and 22 are orthogonal and the longitudinal directions of the first group of electrodes and the second group of electrodes are orthogonal.

The middle substrate 30 is disposed so as to be bonded to the flat surface 16A of the plate 16 and to the flat surface 26A of the plate 26 so as to form a gap 32.

The surfaces 16A and 26A are disposed in parallel to each other whereby the gap between the surfaces 16A, 26A is substantially equal to any position. The gap 32 is made in a vacuum and then filled with an inert gas, such as neon or argon gas. A plurality of picture elements are made in the gap, at the cross points of the first group of electrodes 14 and the second group of electrodes 24. The first group of electrodes 14 are referred to as X electrodes and the second group of electrodes 24 are referred to as Y electrodes.

FIG. 12 is a block diagram of a control circuit for the display panel 1. The control circuit includes an X drive circuit 30X for the X electrodes 14 and a Y drive circuit 30Y for the Y electrodes 24. The X drive circuit 30X has output terminals $E_{11} \ldots E_{ij} \ldots E_{mm}$, which are equal in number to the X electrodes 14 and are respectively connected to the X electrodes.

The Y drive circuit 30Y has output terminals $F_{11} \ldots F_{ij} \ldots F_{nn}$, which are equal in number to the Y electrodes 24 and are respctively connected to the Y electrode lines.

In FIG. 12, the number of the X electrodes and the number of Y electrodes are respectively nine.

Referring to FIGS. 13*a*, 13*b* and 13*c*, the voltages applied to the display panel 1 and the luminescent operation of the panel 1 resulted by applying the voltages to the display panel 1 by the control circuit will be described.

FIG. 13*a* shows the voltage applying state for the picture elements and the luminous state which results from applying the voltage. FIG. 13*b* shows the voltage applying state for applying the voltage from the X drive circuit 30X to the X electrodes. FIG. 13*c* shows the voltage applying state for applying the voltage from the Y drive circuit 30Y to the Y electrodes. In FIGS. 13*a*, 13*b* and 13*c* the reference $V_s$ designates the AC sustaining drive voltge which is applied to all of the picture elements;

$V_{sx}$ designates the sustaining drive voltage applied to the X electrodes;

$V_{sy}$ designates the sustaining drive voltage applied to the Y electrodes;

$V_p$ designates the turn-on pulse;

$V_{px}$ designates the turn-on pulse applied to the X electrodes;

$V_{py}$ designates the turn-on pulse applied to the Y electrodes;

$V_q$ designates the turn-off pulse;

$V_{qx}$ designates the turn-off pulse applied to the X electrodes;

$V_{qy}$ designates the turn-off pulse applied to the Y electrodes;

$\pm V_f$ designates the discharge initiation voltage of each picture element and L designates luminescence.

The sustaining drive voltages $V_{sx}$, $V_{sy}$ have equal repeating periods and pulse widths to each other, and have a phase difference so that one pulse is generated at the middle of the quiescent time of the other pulse. The peak value of the sustaining drive voltage is selected to be lower than the discharge initiation voltage $\pm V_f$. The voltage $V_{sx}$ is applied to all of the X electrodes and the voltage $V_{sy}$ is applied to all of the Y electrodes. The voltages $V_{sx}$, $V_{sy}$ provide a positive polarity to the X electrodes and the Y electrodes. The turn-on pulses $V_{px}$, $V_{py}$ are simultaneously applied to the picture elements which will be luminous in opposite polarity to each other. The peak values of the turn-on pulses $V_{px}$, $V_{py}$ are respectively one half of the peak value of the turn-on pulse $V_p$. The turn-off pulses $V_{qx}$, $V_{qy}$ are also simultaneously applied to the picture elements in opposite polarity to each other. The peak values of the turn-off pulses $V_{qx}$, $V_{qy}$ are respectively one-half of the peak value of the turn-off pulses $V_q$. The peak value of the turn-off pulse $V_q$ is lower than the sustaining drive voltage $V_{sx}$.

Referring to FIGS. 13*a*, 13*b* and 13*c*, the operation of the display panel of FIG. 1 will now be explained. In order to drive the display panel, the AC sustaining drive voltage $V_s$ of FIG. 13*a* is always applied across the discharge gap 32 of the picture elements through the X electrodes and the Y electrodes, and when the turn-on of certain picture elements is required, a discharge occurs for the picture elements by applying the turn-on pulse $V_p$ which provides a level which is higher than the discharge initiation voltage $V_f$.

Once the discharge has occurred, the luminescence L is intermittently given until the turn-off pulse $V_q$ of FIG. 13*a* is applied.

FIG. 3 is a diagram illustrating one embodiment of the drive circuit for a display panel of the conventional AC drive discharge type display apparatus, wherein $V_s$ designates a sustaining drive voltage terminal; $V_p$ designates a turn-on voltage terminal; $S_{ai}(i = 1,2,3)$ $S_{bj}(j = 1,2,3)$ designate selective switch circuits; and $E_{ij}(i, j = 1,2,3)$ designate output terminals. The drive circuit is a matrix type circuit wherein AND circuits are formed by the resistances and the diodes. In FIG. 3, nine lines of the liner electrodes 14 (FIG. 1) are provided as the X electrodes of the display panel and the output terminals $E_{ij}$ are connected to one linear electrode 14 of the X electrodes of the display panel, and therefore the linear electrodes 14 are connected through the output terminals $E_{ij}$, to three circuit elements which consist of two diodes $D_a$, $D_b$ and one resistance $R_a$.

In the drive circuit, the sustaining drive voltage $V_s$ having the waveform of FIG. 13*b*, is applied as an input to the sustaining drive voltage terminal $V_s$, is passed through the diode $D_a$ to the output terminal $E_{ij}$ for the X electrode, and then is passed through the diode $D_b$ and a selective switch circuit $S_{bj}$ of a switch element, e.g., a transistor which is usually in the ON state, to the sustaining drive voltage terminal $V_s$. In order to apply the turn-on pulse shown in FIG. 13*b*, one switch of the first selective switch circuit $S_{ai}$ which is connected to the turn-on voltage terminal $V_p$, is turned on and one switch of the second selective switch circuit $S_{bj}$ is turned off, whereby the turn-on pulse $V_p$ is applied through one terminal of the output terminal $E_{ij}$ to one linear electrode 14 of the X electrodes of the display panel. For example, when the turn-on pulse $V_{px}$ is applied to the X electrodes which is connected to the output terminal $E_{22}$, the switch $S_{a2}$ is turned on and the switch $S_{b2}$ is turned off, whereby the current is passed through three transverse resistances $R_a$ connected to the switch $S_{a2}$. However, since the switches $S_{b1}$ and $S_{b2}$ are in the ON state, the current passing through the vertical lines is passed through the diode $D_b$ and the switches $S_{b1}$, $S_{b3}$ to the sustaining drive voltage terminal $V_s$, and accordingly the turn-on pulse $V_{px}$ is not applied to the X electrodes connected to the output terminals $E_{21}$, $E_{23}$, and the turn-on pulse $V_{px}$ is applied only to the X electrode connected to the output terminal $E_{22}$ in the line of the switch $S_{b2}$ which is in the OFF state. The selectivity is a characteristic of the AND circuit which consists of the resistance and the diode. The turn-off pulse $V_{qx}$ (FIG. 13*b*) can also be applied separately to each of the linear electrodes of the X electrode in a manner similar to the case of the turn-on pulse $V_{px}$.

While somewhat satisfactory, the conventional drive circuit for the display panel using the AND circuit system of the resistance and the diode disadvantageously requires a large consumption of power since an unnecessary current is passed through the resistance $R_a$ to the circuit connected to the linear electrodes 14 to which the turn-on pulse and the turn-off pulse are not applied.

The conventional drive circuit also disadvantageously requires three circuit elements consisting of two diodes $D_a$, $D_b$ and one resistance $R_a$ for each linear electrode 14, and accordingly the number of circuit elements is large.

SUMMARY OF THE INVENTION

Accordingly, it is an object of the present invention to provide a new and improved unique AC drive discharge type display apparatus which overcomes the disadvantages of the conventional technology and which decreases the number of circuit elements of the drive circuit and decreases useless power consumption.

It is another object of the present invention to provide a new and improved unique control apparatus for a matrix type display panel having a plurality of picture elements such as a plasma display.

Briefly, in accordance with the present invention, the foregoing and other objects are attained by providing an AC drive discharge type display apparatus having a plurality of first electrical paths, a plurality of second electrical paths and a plurality of transistors disposed in a matrix form, wherein each emitter-base circuit is connected between a pair of the first and the second electrical paths and each collector is connected to each electrode of a discharge type display panel. A sustaining drive power source for applying a sustaining drive voltage through the transistors to the electrodes of the discharge type display panel is provided whereby each level of the electrodes of the discharge type display panel is controlled through the emitter-collector and base-collector circuit of the transistor. For example, in the case wherein PNP type transistors are used as the transistors disposed in a matrix form, the current passes through the emitter-collector circuit at increasing timing of the sustaining drive voltage and passes through the collector-base circuit at decreasing timing of the sustaining drive voltage, and also in the case wherein NPN type transistors are used, the current passes through the base-collector circuit at increasing timing of the sustaining drive voltage and the emitter-collector circuit at decreasing timing of the sustaining drive voltage.

The present invention is also to provide an AC drive discharge type display apparatus which includes a display panel having groups of transverse electrodes and vertical electrodes which are disposed in cross form across a discharge gap and which has cross points (picture elements) that are made luminescent or extinct by applying an AC sustaining drive voltage, a turn-on signal and a turn-off signal. A drive circuit is provided for driving the display panel which includes transistors wherein the emitters or the bases of the transistors in transverse lines of the matrix are commonly connected and are each connected through a first diode to a sustaining drive voltage source and the bases or the emitters of the transistors in vertical lines of the matrix are commonly connected and are each connected through a second diode to the sustaining drive voltage source.

A first selective switch circuit is provided for applying a turn-on signal or a turn-off signal by connecting the switch to the commonly connected emitters or bases of the transistors in transverse lines and selectively driving the transverse lines of the matrix and a second selective switch circuit is provided for applying a turn-on signal or a turn-off signal by selectively driving the vertical lines of the matrix. The collectors of the transistors in the drive circuit are connected to one or both of the groups of the electrodes in the transverse direction and vertical direction of the display panel.

BRIEF DESCRIPTION OF THE DRAWINGS

A more complete appreciation of the invention will become apparent as the same becomes better understood by reference to the following detailed description when considered in connection with the accompanying drawings wherein.

DETAILED DESCRIPTION OF THE PREFERRED EMBODIMENTS

Figure 1:
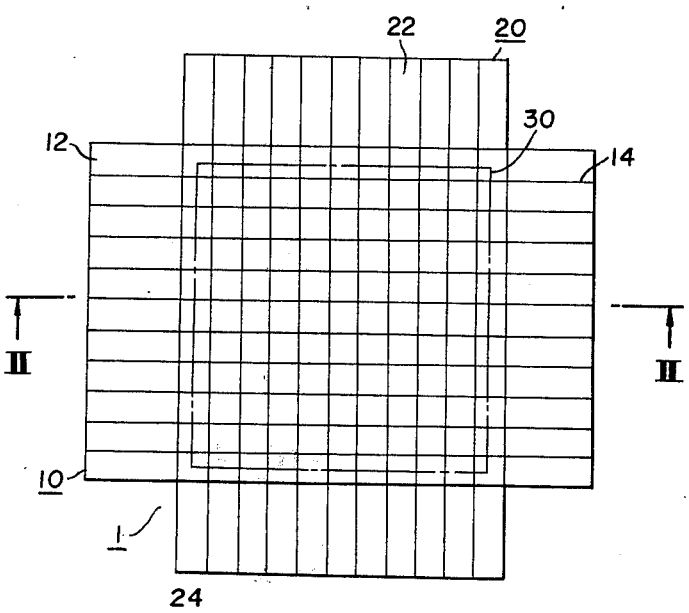
FIG. 1 is a plane view of a discharge type display panel.
Figure 2:
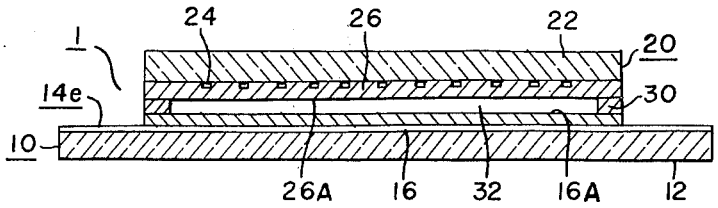
FIG. 2 is a sectional view taken along the line II—II of FIG. 1.
Figure 3:
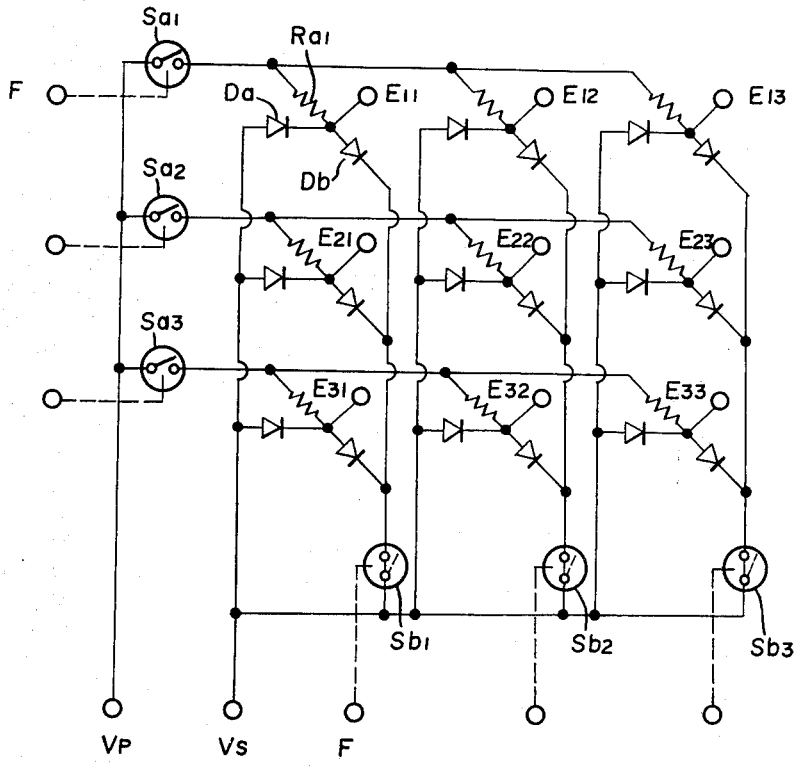
FIG. 3 is a circuit diagram for illustrating a display panel drive circuit of a conventional AC drive discharge type display apparatus.
Figure 4:
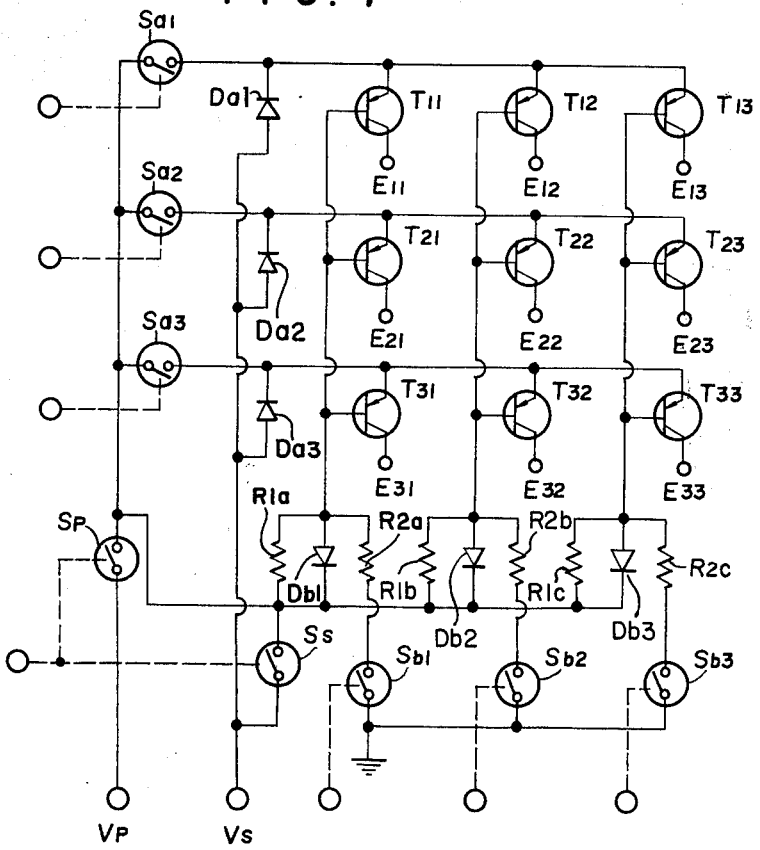
FIGS. 4 – 7 are respectively circuit diagrams for showing embodiments of display panel drive circuits of an AC drive discharge type display apparatus according to the present invention.

Referring now to the drawings, one preferred embodiment of the present invention will be illustrated. FIG. 4 is a circuit of an AC drive discharge type display apparatus according to the present invention, wherein $T_{ij}$ ($i, j = 1,2,3$) designates a transistor; $S_p$ and $S_s$ designate switches; and $R_{1i}$ and $R_{2i}$ designate resistances. The drive circuit is used for the X electrodes of nine linear electrodes 2 (FIG. 1) of the display panel.

The structure of the circuit will now be explained. The drive circuit has a matrix structure using a plurality of unit circuits each consisting of one PNP type transistor $T_{ij}$ and wherein each output terminal $E_{ij}$ for an X electrode is connected to the collector electrode of the transistor $T_{ij}$ in each unit circuit. The emitter electrodes of the transistors $T_{ij}$ in each transverse unit circuit of the matrix are commonly connected to one transverse line and the transverse line is connected to a first selective switch circuit $S_{ai}$ which is connected through the switch $S_p$ to a turn-on voltage terminal $V_p$, and is also connected through a diode $D_{ai}$, which is connected in the forward direction to the base-emitter junction of the transistor $T_{ij}$ to a sustaining drive voltage terminal $V_s$. On the other hand, the base electrodes of the transistors $T_{ij}$ in each vertical unit circuit of the matrix are commonly connected to one vertical line and the vertical line is connected through a diode $D_{bi}$, which is connected in the forward direction to the base-emitter junction of the transistor $T_{ij}$, and the switch $S_s$ to the sustaining drive voltage terminal $V_s$, and is also connected through the resistance $R_{2i}$ and a second selective switch circuit $S_{bj}$, for selecting the vertical lines of the matrix, to ground. The resistance $R_{1i}$ is connected in parallel to the diode $D_{bi}$ and one end of the resistance $R_{1i}$ is connected through the switch $S_p$ to the turn-on voltage terminal $V_p$.

Figure 13A:
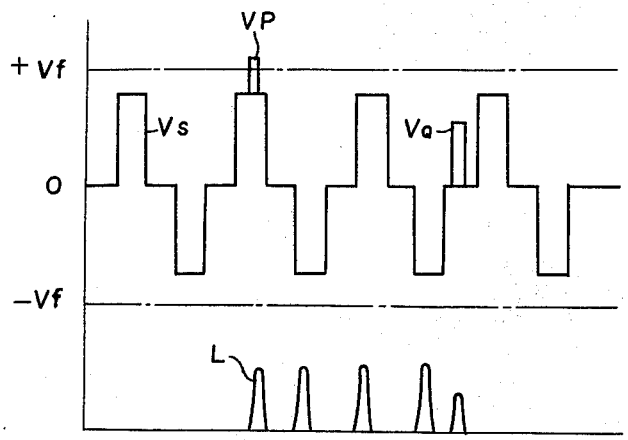
FIG. 13*a*, 13*b*, and 13*c* are waveforms for illustrating the applications of voltage to the display panel.
Figure 13B:
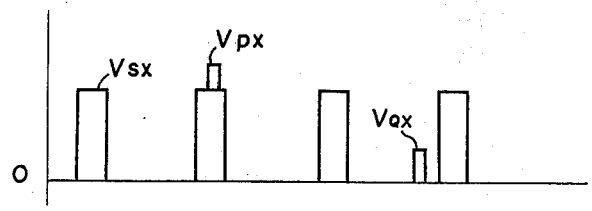

The operation of the drive circuit will be described. The first selective switch circuit $S_{ai}$ and the switch $S_p$ are usually in the OFF state, and the second selective switch circuit $S_{bj}$ and the switch $S_s$ are usually in the ON state. In this state, the sustaining drive voltage $V_{sx}$ (FIG. 13*b*) is applied as an input to the sustaining drive voltage terminal $V_s$. When the position voltage $V_s$ is applied to the terminal $V_s$, the positive voltage $V_s$ is applied through the diode $D_{ai}$ to the emitter electrode of the transistor $T_{ij}$. Accordingly, since the selective switch circuit $S_{bj}$ is in the ON state so as to be connected to ground, the base voltage of the transistor $T_{ij}$ is lower then the emitter voltage and a base current is passed whereby the transistor $T_{ij}$ is in the ON state. Thus, the voltage at the output terminal $E_{ij}$ which is connected to the collector electrode of the transistor $T_{ij}$, that is the X electrode of the display panel, is substantially equal to the positive voltage $V_s$. When the terminal $V_s$ becomes a zero potential, the zero potential is applied through the diode $D_{bi}$ and the switch $S_s$ to the base voltage of the transistor $T_{ij}$, whereby the forward bias is applied between the collector-base electrode of the transistor $T_{ij}$. The voltage at the collector electrode, that is the output terminal $E_{ij}$, is substantially equal to a zero voltage. As stated above, when the first selective switch circuit $S_{ai}$ and the switch $S_p$ are in the OFF state and the second selective switch circuit $S_{bj}$ and the switch $S_s$ are in the ON state, and the sustaining drive voltage $V_{sx}$ (FIG. 13*b*) is applied to the sustaining drive voltage terminal $V_s$, the drive waveform which has a substantially equal pulse width and level to that of the sustaining drive voltage $V_{sx}$ applied to the terminal $V_s$, is applied to the output terminal $E_{ij}$, that is the X electrode of the display panel, which is connected to the collector electrode of the transistor $T_{ij}$. Moreover, in this case every load current passes the diodes and the transistors whereby the power loss is quite low.

The operation of applying the turn-on pulse $V_{px}$ to only the output terminal $E_{22}$ will now be explained. In this case, the switches $S_p$ and $S_{a2}$, $S_{b2}$ are in the ON state and the switches $S_s$, $S_{a1}$, $S_{a3}$, $S_{b1}$ and $S_{b3}$ are in the OFF state, whereby the turn-on pulse $V_{px}$ which is applied as an input to the terminal $V_p$ is applied through the switches $S_p$, $S_{a2}$ to the emitter electrode of the transistor $T_{2j}$ in the transverse line of the switch $S_{a2}$. On the other hand, the turn-on pulse voltage $V_p$ is applied through the switch $S_p$ and the resistance $R_{1i}$ to the base electrodes of the transistors $T_{i1}$, $T_{i3}$ in the vertical lines of the switches $S_b$, $S_{b3}$. Accordingly, a voltage which is lower than the turn-on pulse voltage $V_p$ is applied to the base electrode of the transistor $T_{i2}$ in the vertical line of the switch $S_{b2}$, since the switch $S_{b2}$ is in the ON state so as to be connected through the resistance $R_{2b}$ to ground. Only the sustaining drive voltage $V_{sx}$ which is lower than the turn-on pulse voltage $V_p$ is applied from the terminal $V_s$ to the emitter electrodes of the transistors $T_{1j}$, $T_{3j}$ in the transverse lines of the switches $S_{a1}$, $S_{a3}$. Accordingly, in this state, only the transistor $T_{22}$ is in the ON state by applying a forward bias between the emitter-base, whereby a pulse voltage which is substantially equal to the turn-on pulse $V_{px}$ is provided as an output to only the output terminal $E_{22}$ which is connected to the collector electrode of the transistor $T_{22}$.

Incidentially, it should be understood that it is also possible to apply the turn-on pulse $V_{px}$ to the output terminal $E_{ij}$ by selectively driving the first selective switch circuit $S_{ai}$ and the second selective switch circuit $S_{bj}$. In the time period for applying the turn-on pulse, all of the load current passes through the transistor $T_{ij}$, whereby the power loss is low. The operation of applying the turn-off pulse $V_{qx}$ is similar to that of the turn-on pulse. In this case, the turn-off pulse $V_{qx}$ (FIG. 13*b*) is applied to the turn-on voltage terminal $V_p$. As stated above, it should now be apparent that the drive circuit of FIG. 4 has a smaller number of required circuit elements then the prior art and the power loss is low.

Figure 5:
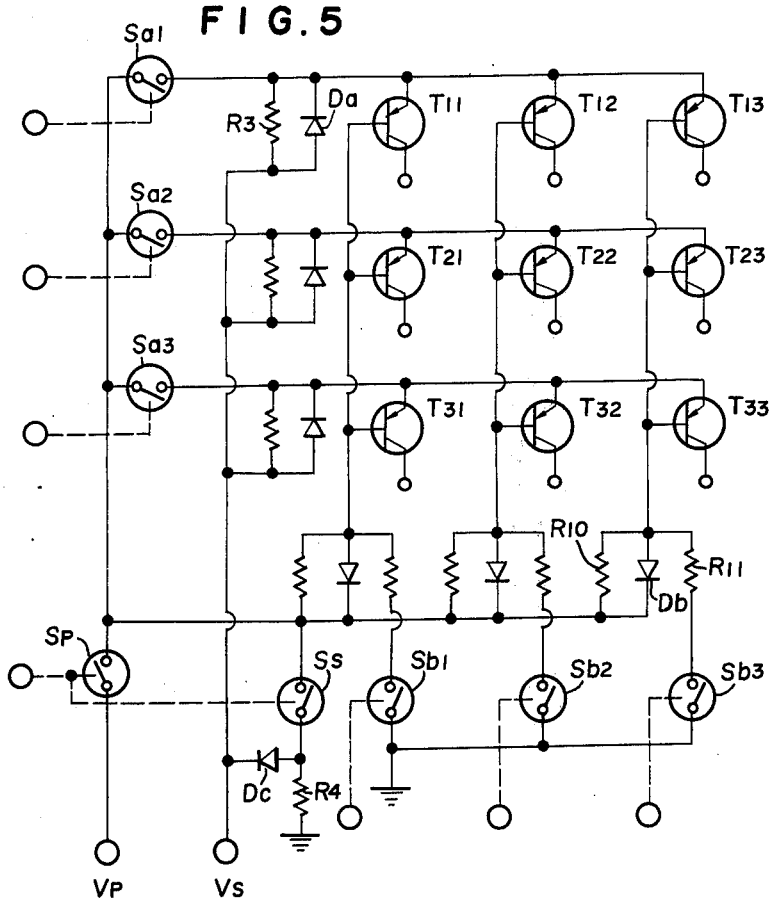

FIG. 5 is a circuit diagram of another preferred embodiment of the display panel drive circuit of the AC drive discharge type display apparatus of the present invention, wherein $R_3$, $R_4$ designate resistances and $D_c$ a diode. In this circuit, the diode $D_a$ is connected in parallel to the resistance $R_3$ whereby the storage carrier of the transistor $T_{ij}$ and the diode $D_a$, which may change to the ON state even during the turn-on pulse application, is passed from the sustaining drive voltage terminal $V_s$ through the resistance $R_3$ to the sustaining drive power source at the time of completion of the turn-on pulse $V_{px}$ which is applied to the base electrode of the transistor $T_{ij}$. Accordingly, the emitter potential of the transistor $T_{ij}$ rapidly corresponds to the level of the sustaining drive voltage $V_{sx}$ so that the emitter potential of the transistor $T_{ij}$ is kept lower than the base potential and the OFF state of the transistor $T_{ij}$ is secured and the switching operation is stabilized. In this circuit, the diode $D_c$ is inserted between the switch $S_s$ and the sustaining drive voltage terminal $V_s$ and the contact between the diode $D_c$ and the switch $S_s$ is connected through the resistance $R_4$ to ground, whereby the base electrode of the transistor $T_{ij}$ is connected through the resistance $R_4$ to ground when the sustaining drive voltage $V_{sx}$ at the sustaining drive voltage terminal $V_s$ is of a positive voltage $V_s$. Accordingly, the voltage at the base electrode of the transistor becomes lower than the level of the sustaining drive voltage $V_{sx}$ and the transistor $T_{ij}$ is automatically in the ON state. Accordingly, in the embodiment of FIG. 4, the selective switch circuit $S_{bj}$ is usually in the ON state and the base current of the transistor $T_{ij}$ is passed through the selective switch circuit $S_{bj}$ in the time period of applying the sustaining drive voltage $V_{sx}$. However, in the embodiment of FIG. 5, the selective switch circuit $S_{bj}$ is usually in the OFF state, and only the switch in the vertical line for applying the turn-on pulse $V_{px}$ is in the ON state. The basic operation of the circuit of FIG. 5 is similar to the operation of the embodiment of FIG. 4.

Incidentally, it should be understood that in the embodiment of FIG. 5 the base bias circuit of the resistance $R_4$ and the diode $D_c$ can be modified by eliminating the diode $D_c$ and the resistance $R_4$ and by connecting the forward bias power source between the emitter-base of the transistor $T_{ij}$ in the same position as that of the diode $D_c$, whereby the same effect can be obtained. In the embodiment of FIG. 5, one end of the selective switch circuit $S_{bj}$ is connected to ground, however, it should be clear that the potential is not limited to ground potential and can be lower than the voltage of the turn-on pulse $V_{px}$.

Figure 6:
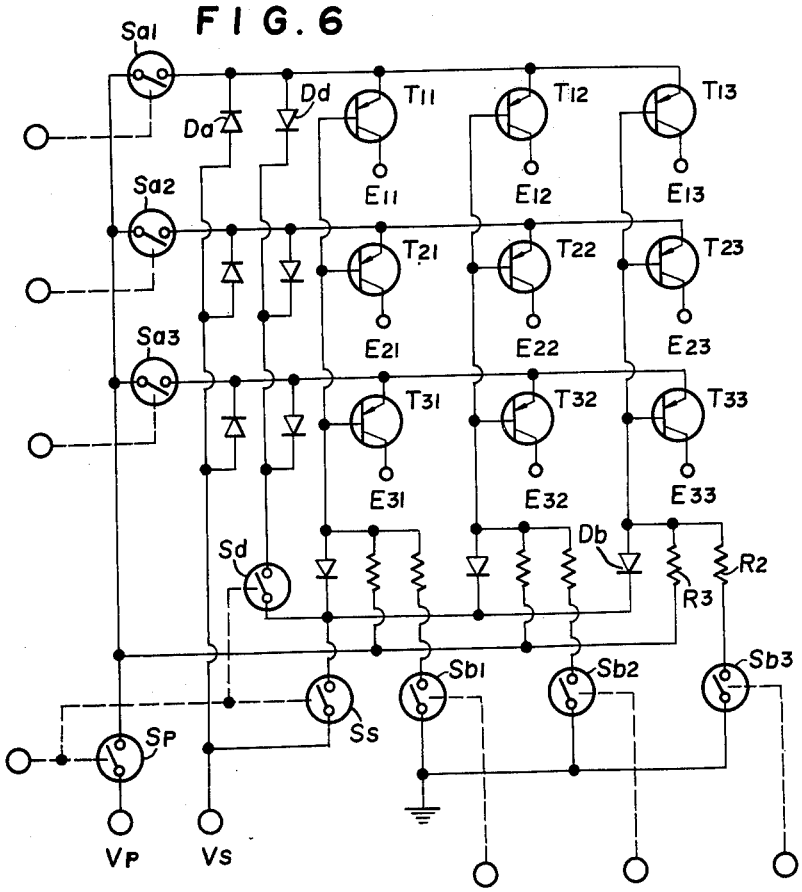

FIG. 6 is a circuit diagram of still another preferred embodiment of the display panel drive circuit of the AC drive discharge type display apparatus of the present invention, wherein $D_d$ designates a diode and $S_d$ designates a switch. This circuit comprises a circuit connecting the vertical line of the matrix through the diode $D_d$ to one end of the switch $S_d$ and connecting the other end of the switch $S_d$ to the connection between the diode $D_d$ and the switch $S_s$ in the circuit of FIG. 4. The switch $S_d$ is driven in the time period such that the switch $S_d$ is in the OFF state just after the moment of changing of the switch $S_p$ to the OFF state and subsequently the switch $S_s$ is changed to the ON state. Accordingly, when it is changed from the state wherein the turn-on pulse $V_{px}$ is applied to the stage wherein the sustaining driving voltage $V_{sx}$ is applied by the switching, the voltage levels of the base electrode and the emitter electrode of the transistor $T_{ij}$ can be shifted in substantially the same level, whereby the transistor $T_{ij}$ is shifted without failure while maintaining the OFF state and the operation of the transistor $T_{ij}$ is further stabilized. The base operation of the circuit of FIG. 6 is similar to that of FIG. 4.

Figure 7:
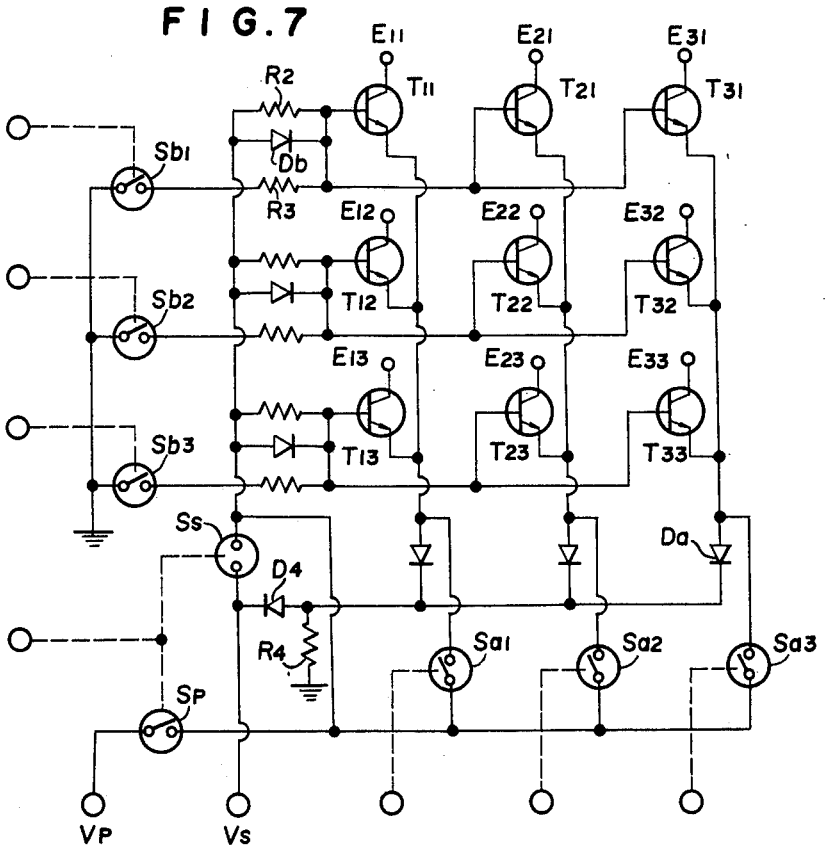

FIG. 7 is a circuit diagram of yet one other preferred embodiment of the display panel drive circuit of the AC drive discharge type display apparatus of the present invention. This circuit is used to drive the Y electrodes of the display panel. The transistor $T_{ij}$ is an NPN type transistor. In the difference of the X electrodes the voltages of the turn-on pulse $V_{px}$ and the turn-off pulse $V_{qx}$ (FIG. 13*b*) are negative.

Figure 13C:
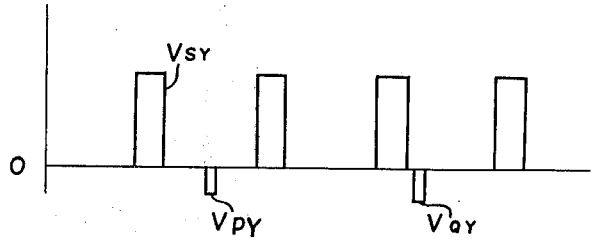

The operation of this drive circuit will now be explained. In this circuit, the first selective switch circuit $S_{ai}$, the second selective switch circuit $S_{bi}$, and the switch $S_p$ are usually in the OFF state, and the switch $S_s$ is usually in the ON state. In this state, the sustaining drive voltage $V_{sy}$ (FIG. 13*c*) is applied as an input to the sustaining drive voltage terminal $V_s$. When the positive voltage $V_s$ is applied to the terminal $V_s$, the positive voltage $V_s$ is applied through the diode $D_b$ to the base electrode of the transistor $T_{ji}$. In this case, the emitter electrode of the transistor $T_{ji}$ is connected through the diode $D_a$ and the resistance $R_4$ to ground. However, the emitter voltage of the transistor $T_{ji}$ is maintained to be substantially the same as the base voltage by the current limiting of the resistance $R_4$, whereby the collector potential is substantially equal to the base voltage, that is the positive voltage $V_s$. Subsequently, when the terminal $V_s$ becomes of a zero voltage, the base current is passed to change the transistor $T_{ji}$ to the ON state since the emitter electrode of the transistor $T_{ji}$ is connected through the diode $D_a$ and the resistance $R_4$ to ground. Accordingly, the collector voltage decreases to a zero voltage depending upon the decrease of the base voltage which results by lowering of the sustaining drive voltage $V_{sy}$. Accordingly, a drive waveform, which has a pulse width and a level substantially equal to the pulse width and the level of the sustaining drive voltage $V_{sy}$ applied as an input to the terminal $V_s$, is applied to the output terminal $E_{ji}$, that is the Y electrode of the display panel which is connected to the collector electrode of the transistor $T_{ji}$. In this case, every load current is passed through the diode and the transistor, whereby the power loss is small.

The operation of applying the turn-on pulse $V_{py}$ to only the output terminal $E_{22}$ will now be described. In this case, the switch $S_s$ is in the OFF state and the switch $S_p$ and the switches $S_{a2}$, $S_{b2}$ are in the ON state. The negative turn-on pulse $V_{py}$, applied as an input to the turn-on voltage terminal $V_p$ is applied through the resistance $R_2$ to the base electrodes of the transistors $T_{j1}$, $T_{j3}$ in the transverse lines of the switches $S_{b1}$, $S_{b3}$. This voltage which is slightly higher than the turn-on voltage $V_p$ is applied through the switch $S_{b2}$ to the base electrode of the transistor $T_{j2}$ in the transverse line of the switch $S_{b2}$. On the other hand, the negative turn-on pulse voltage $V_p$ is not applied to the emitter electrodes of the transistors $T_{1i}$, $T_{3i}$ in the vertical lines of the switches $S_a$, $S_{a3}$ in the OFF state. Accordingly, the transistors $T_{1i}$, $T_{3i}$ are in the OFF state. On the other hand, the negative turn-on pulse voltage $V_p$ is applied through the switch $S_{a2}$, to the emitter electrode of the transistor $T_{2i}$ in the vertical line of the switch $S_{a2}$ in the ON state.

Accordingly, the voltage level of the base electrode and the emitter electrode of the transistor $T_{21}$, $T_{23}$ are substantially the same, whereby the transistors $T_{21}$, $T_{23}$ are in the OFF state, and the forward bias is applied between the base-emitter of the transistor $T_{22}$, and the transistor $T_{22}$ becomes in the ON state and the voltage which is substantially the same as the turn-on pulse $V_{py}$ is taken as an output from the output terminal $E_{22}$ which is connected the collector electrode of the transistor $T_{22}$. It should be understood that it is also possible to apply the turn-on pulse $V_{py}$ to the output terminal $E_{ji}$ be selectively driving the selective switch circuits $S_{aj}$ and $S_{bi}$ in the same manner as the output terminal $E_{22}$. In the drive circuit for the Y electrodes of the display panel, every load current is passed through the transistor in the turn-on pulse application the same as with the drive circuit for the X electrodes, whereby the power loss is low. The operation of applying the turn-off pulse $V_{qy}$ (FIG. 13*c*) is similar to that of the turn-on pulse.

Figure 8:
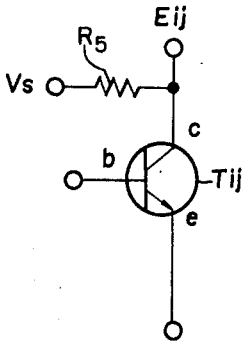
FIGS. 8 and 9 are respectively unit circuit diagrams.

FIG. 8 is a diagram of a preferred embodiment of a unit circuit for the drive circuit of the present invention, wherein $R_5$ designates a resistance. FIG. 8 shows only the transistor $T_{ij}$ for forming the matrix of the drive circuit, wherein the collector electrode of the transistor $T_{ij}$ is connected through the resistance $R_5$ to the sustaining drive voltage terminal $V_s$ and whereby the collector voltage is maintained through the resistance $R_5$ to the sustaining drive voltage $V_{sx}$ or $V_{sy}$ (FIG. 13*b*) in the OFF state of the transistor $T_{ij}$, and the voltage level at the output terminal $E_{ij}$ is stabilized.

Figure 9:
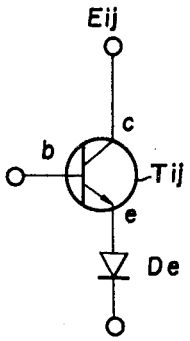

FIG. 9 is a diagram of another preferred embodiment of the unit circuit for the drive circuit of the present invention wherein $D_e$ designates a diode. In FIG. 9, the diode $D_e$ is connected to the emitter of the transistor $T_{ij}$ in the forward direction of the base-emitter junction, whereby the diode $D_e$ prevents passing of the reverse current between the base and the emitter of the transistor $T_{ij}$, and the operation of the transistor $T_{ij}$ is stabilized. It should be understood that a similar effect can also be given by connecting the diode $D_e$ to the base electrode of the transistor $T_{ij}$.

Figure 10:
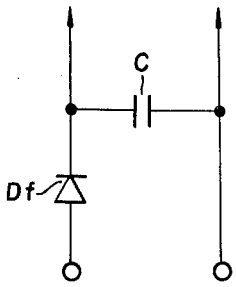
FIG. 10 is a partial circuit diagram of another embodiment of an input circuit to the drive circuit according to the present invention.
Figure 11:
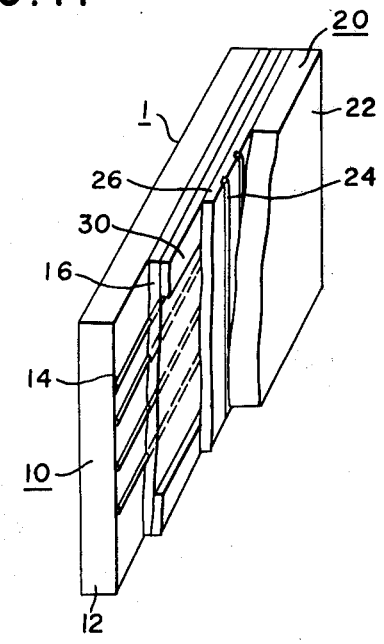
FIG. 11 is a partially broken schematic view of a discharge type display panel.

Incidentally, in the embodiments of FIGS. 4–7, when the turn-on pulse voltage, applied as an input to the turn-on voltage terminal $V_p$, is a pulse having a predetermined pulse width and amplitude, the maximum value of the turn-on pulse width is fixed so as to improve the stability of the operation of the drive circuit. The switch $S_p$ for the turn-on pulse can be replaced by a diode. Also, in the embodiment of FIG. 6, the switch $S_d$ is unnecessary and similar operation stability can be obtained by changing connection of the wire connected through the diode $D_d$ to the switch $S_d$, to the connection of the contact between the switch $S_p$ and the switch $S_{a3}$. Thus, when the pulse voltage having the predetermined pulse width and amplitude is applied as the turn-on pulse voltage input to the terminal $V_p$, the operation stability of the drive circuit is improved and the structure of the circuit is simplified. Moreover, when the turn-on pulse voltage is applied as an input to the drive circuit through the diode $D_f$ and the voltage is added to the sustaining drive voltage by a capacitor C as shown in FIG. 10, then the voltage of the pulse applied as an input to the turn-on voltage terminal $V_p$ can be of a low value by subtracting the sustaining drive voltage from the turn-on voltage. Incidentally, the direction of the connection of the diode $D_f$ in the input circuit of FIG. 10 is provided under the condition of applying a positive voltage to the turn-on voltage terminal $V_p$. When a negative voltage is applied, the direction of the connection should be reversed.

Additionally, in the embodiments of FIGS. 4 – 6, a PNP type transistor is used. However, a similar drive circuit can be formed by using NPN type transistors.

As it is clear from the description, the present invention is to provide an AC drive discharge type display apparatus having a decreased number of circuit elements, and a low power loss with the stability of operation of the drive circuit improved by using the pulse voltage having a desirable pulse width and amplitude.

Figure 14:
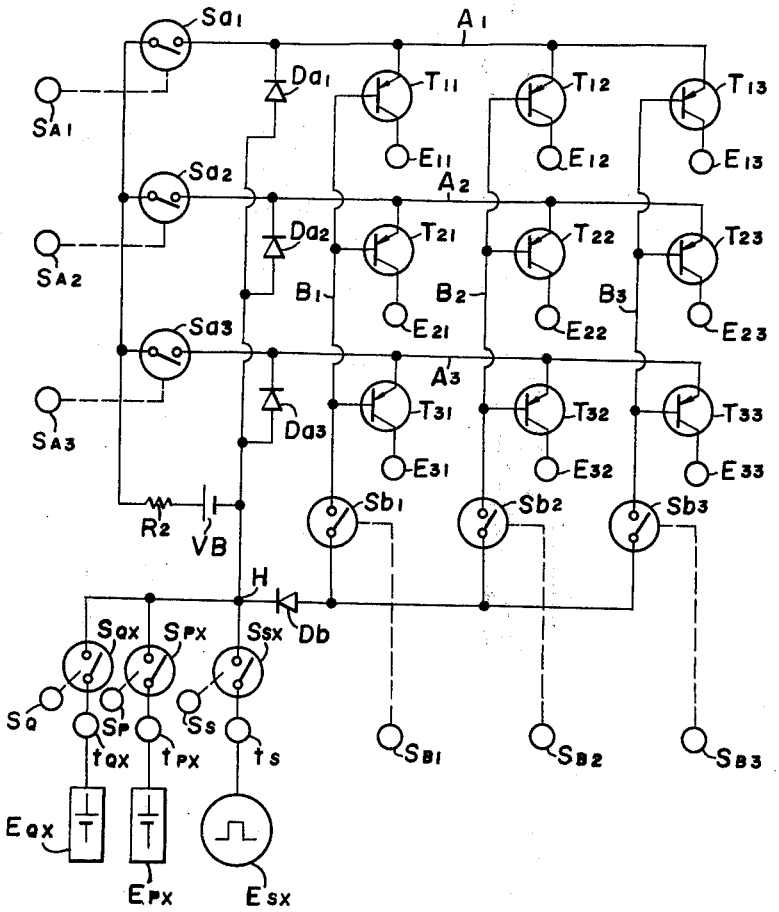
FIGS. 14 – 16 are respectively circuit diagrams for showing other preferred embodiments of X drive circuits according to the present invention.

Other preferred embodiments having even a simple structure will now be explained. FIG. 14 is a circuit diagram of one preferred embodiment of an X drive circuit wherein nine X electrodes are used. A drive circuit having a larger number of X electrodes can be formed by a similar structure. The drive circuit has a pair of electrical lines A, B arranged in a matrix structure. The first electrical lines A are transverse lines which compose three lines $A_1$, $A_2$, $A_3$. The second electrical lines B are vertical lines which compose three lines $B_1$, $B_2$, $B_3$. In the electrical lines A and B, nine PNP transistors $T_{11} \ldots T_{33}$ are connected. The emitters of the transistors $T_{11}$, $T_{12}$, $T_{13}$ are connected to the electrical line $A_1$, the emitters of the transistors $T_{21}$, $T_{22}$, $T_{23}$ are connected to the electrical line $A_2$ and the emitters of the transistors $T_{31}$, $T_{32}$, $T_{33}$ are connected to the electrical line $A_3$. The bases of the transistors $T_{11}$, $T_{21}$, $T_{31}$ are connected to the electrical line $B_1$, the bases of the transistors $T_{12}$, $T_{22}$, $T_{32}$ are connected to the electrical line $B_2$ and the bases of the transistors $T_{13}$, $T_{23}$, $T_{33}$ are connected to the electrical line $B_3$. The collectors of the transistors $T_{11} \ldots T_{33}$ are respectively connected to the output terminals $E_{11} \ldots E_{33}$ of the X drive circuit (30X of FIG. 12) and to the X electrodes $X_{11} \ldots X_{33}$. The first selective switches $S_{a1}$, $S_{a2}$, $S_{a3}$ are respectively connected to the ends of the electrical lines $A_1$, $A_2$, $A_3$. The second selective switches $S_{b1}$, $S_{b2}$, $S_{b3}$ are respectively connected to the ends of the electrical lines $B_1$, $B_2$, $B_3$. The selective switches are prepared by using the transistors and are turned on or off by corresponding signal sources $SA_1$, $SA_2$, $SB_1$, $SB_3$. A pulse voltage source $E_{sx}$ for applying the sustaining drive voltage $V_{sx}$, and DC voltage sources $E_{px}$, $E_{qx}$ for applying the turn-on pulse $V_{px}$ and the turn-off pulse $V_{qx}$ are connected. The power sources $E_{sx}$, $E_{px}$, $E_{qx}$ are respectively connected to the terminals $t_s$, $t_{px}$, $t_{qx}$ and through the control switches $S_{sx}$, $S_{px}$, $S_{qx}$ to the common feed point H. The control switches $S_{sx}$, $S_{px}$, $S_{qx}$ are prepared by the transistors and are turned on or off by the corresponding control signal sources $S_s$, $S_p$, $S_q$. The voltage sources $E_{px}$, $E_{qx}$, are DC voltage sources having a value equal to a peak voltage of the turn-on pulse $V_{px}$ and the turn-on pulse $V_{qx}$. When the corresponding control switches $S_{px}$, $S_{qx}$ are turned on, the voltage is applied to the feed point H. The feed point H is connected through diodes $D_{a1}$, $D_{a2}$, $D_{a3}$ to the electrical lines $A_1$, $A_2$, $A_3$ and are also connected through the DC bias power source $V_B$ and the resistance $R_2$ to the selective switches $S_{a1}$, $S_{a2}$, $S_{a3}$. The feed point H is also connected through the diode $D_b$ to the selective switches $S_{b1}$, $S_{b2}$, $S_{b3}$.

The operation of the drive circuit will now be explained with reference first to the operation for applying the sustaining drive voltage $V_{sx}$. In this case, the selective switches $S_{a1} - S_{a3}$; $S_{b1} - S_{b3}$ are controlled in the ON state and the control switch $S_{sx}$ is turned on. The bias voltage source $V_B$ provides a bias current which is passed through a resistance $R_2$, the selective switches $S_{a1} - S_{a2}$, the electrical lines $A_1 - A_3$, the emitters and bases of the transistors $T_{11} - T_{33}$; the electrical lines $B_1 - B_3$; the selective switches $S_{b1} - S_{b3}$; the diode $D_b$ and the feed point H to all of the emitter-base circuits of the transistors $T_{11} - T_{33}$, whereby all of the transistors $T_{11} - T_{33}$ are in the ON state. Accordingly, when the pulse voltage of the pulse power source $E_{sx}$ is applied to the feed point H, the pulse voltage is applied through the diodes $D_{a1} - D_{a3}$ to the electrical lines $A_1 - A_3$, and is also applied through the emitter collector circuits of the transistors $T_{11} - T_{33}$ to the output terminals $E_{11} - E_{33}$ and is applied to the X electrodes. When the pulse voltage is stopped and the pulse power source $E_{sx}$ is of a zero potential, the X electrodes are of a zero potential, however, the picture elements are charged by applying the pulse voltage. The X electrodes maintain the voltage substantially equal to the peak value of the pulse voltage, and accordingly it is necessary to discharge the voltage. The discharge is provided by passing from the output terminals $E_{11} - E_{33}$ through the collectors and bases of the transistors $T_{11} - T_{33}$, the electrical lines $B_1 - B_3$, the selective switches $S_{b1} - S_{b2}$, the diode $D_b$, and the control switch $S_s$, to the pulse voltage source $E_s$. The transistors $T_{11} - T_{33}$ are PNP transistors whereby the current can be passed from the collector to the base. In the X drive circuit (30X of FIG. 12) of the present invention, the phenomenon is effectively utilized to return the X electrodes to a zero potential. The sustaining drive voltage $V_{sx}$ is applied to the X electrodes by repeating the operations. The turn-on pulse $V_{px}$ is selectively applied to the X electrodes of the picture element which will be turned on. The turn-on pulse $V_{px}$ is applied to the feed point H by turning on the control switch $S_{px}$ at the time of turning on. When the turn-on pulse $V_{px}$ is applied, the control switch $S_{sx}$ is controlled in the OFF state.

The case of the application of the turn-on pulse $V_{px}$ to only the output terminal $E_{22}$ will now be explained. In this case, only the selective switches $S_{a2}$, $S_{b2}$ are controlled to be in the ON state. The other selective switches are controlled to be in the OFF state. Only the transistor $T_{22}$ is turned on by the bias voltage source $V_B$ and the other transistors are in the OFF state. Accordingly, the turn-on pulse $V_{px}$ is applied through the diode $D_{a2}$, the electrical line $A_2$, the emitter and collector of the transistor $T_{22}$ to only the output terminal $E_{22}$, and is applied to only the X electrode $X_{22}$. The turn-off pulse $V_{qx}$ is also applied to only the selected output terminal.

The operation for applying to only the selected output terminal $E_{22}$ will be easily understood. The turn-off pulse $V_{qx}$ is applied to the feed point H by turning on the control switch $S_{qx}$. When the control switch $S_{qx}$ is in the ON state, the control switch $S_{sx}$ is controlled to be in the OFF state.

Figure 12:
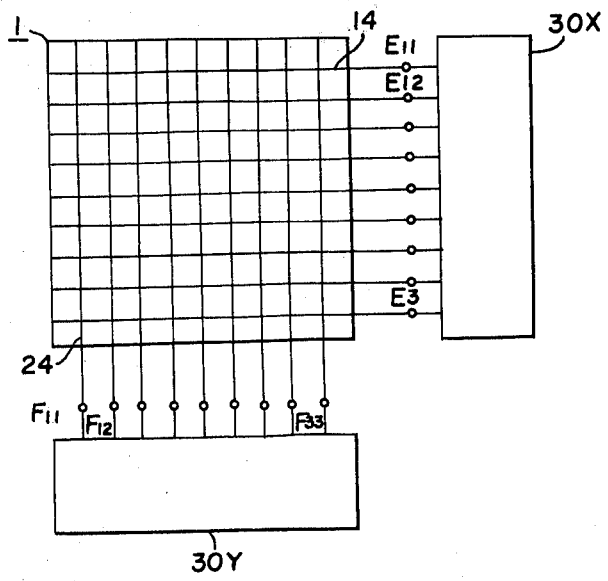
FIG. 12 is a broken diagram of the control circuit for the discharge type display panel.
Figure 15:
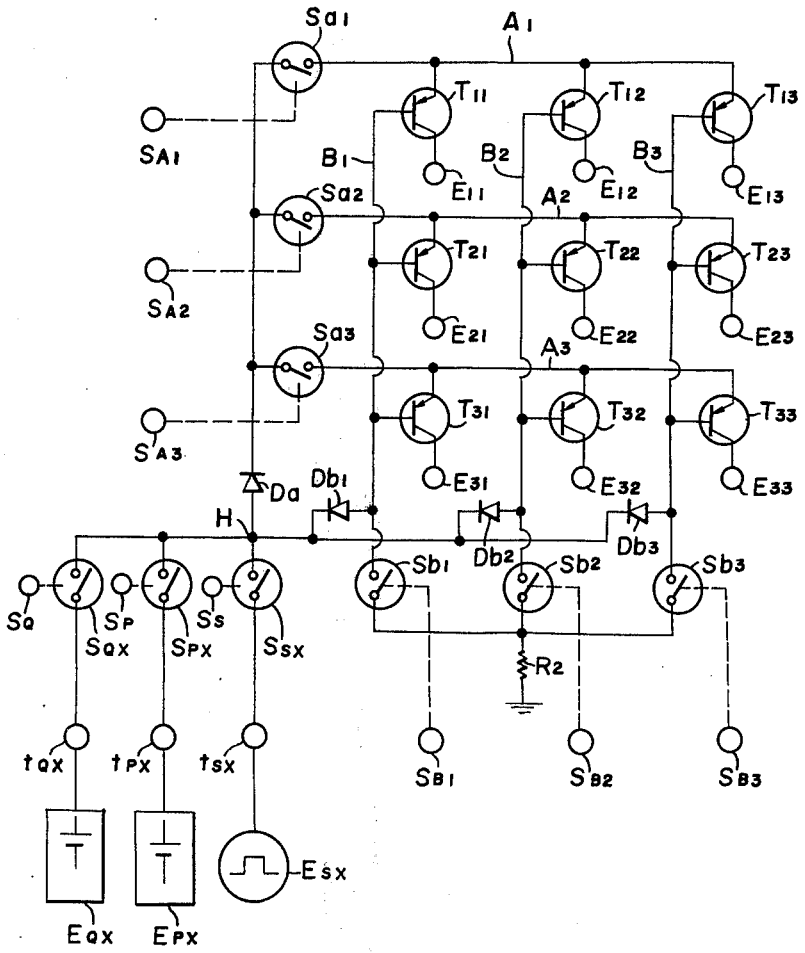

FIG. 15 shows a second preferred embodiment of the X drive circuit (30X of FIG. 12). In this embodiment, the feed point H is connected through the diode $D_a$ to the selective switches $S_{a1} - S_{a3}$, and is also connected through the diodes $D_{b1}$, $D_{b2}$, $D_{b3}$ to the electrical lines $B_1$, $B_2$, $B_3$. In this embodiment, the bias power source $V_B$ is not used and the selective switches $S_{b1} - S_{b3}$ are commonly grounded through the resistance $R_2$. The sustaining drive voltage $V_{sx}$ is applied through the control switch $S_{sx}$ to the feed point H. In the application of the sustaining drive voltage $V_{sx}$, the selective switches $S_{a1} - S_{a3}$, $S_{b1} - S_{b3}$ are controlled to be in the ON state, and the transistors $T_{11} - T_{33}$ are turned on by the pulse of the sustaining drive voltage $V_{sx}$, by passing the base current from the feed point H through the selective switches $S_{a1} - S_{a3}$, the electrical lines $A_1 - A_3$, the emitters and bases of the transistors, the electrical lines $B_1 - B_{b3}$, and the resistor $R_2$ to ground, whereby the pulse voltage is applied through the emitters and collectors of the transistors to the output terminals $E_{11} - E_{33}$. When the pulse power source $E_{sx}$ is of a zero potential, the potential at the output terminals $E_{11} - E_{33}$ are returned to a zero potential by discharging through the collectors and bases of the transistors $T_{11} - T_{33}$, the electrical lines $B_1$, the diodes $D_{b1} - D_{b3}$, the feed point H and the control switch $S_{sx}$ to the pulse power source $E_{cx}$ as in the embodiment of FIG. 14. When the turn-on pulse $V_{px}$ and the turn-off pulse $V_{qx}$ are applied, the control switch $S_{sx}$ is controlled to be in the OFF state and only the selective switch of the electrical line having the output terminal for the output of the pulse is controlled to be in the ON state, and the other selective switches are controlled to be in the OFF state as in the embodiment of FIG. 14.

Figure 16:
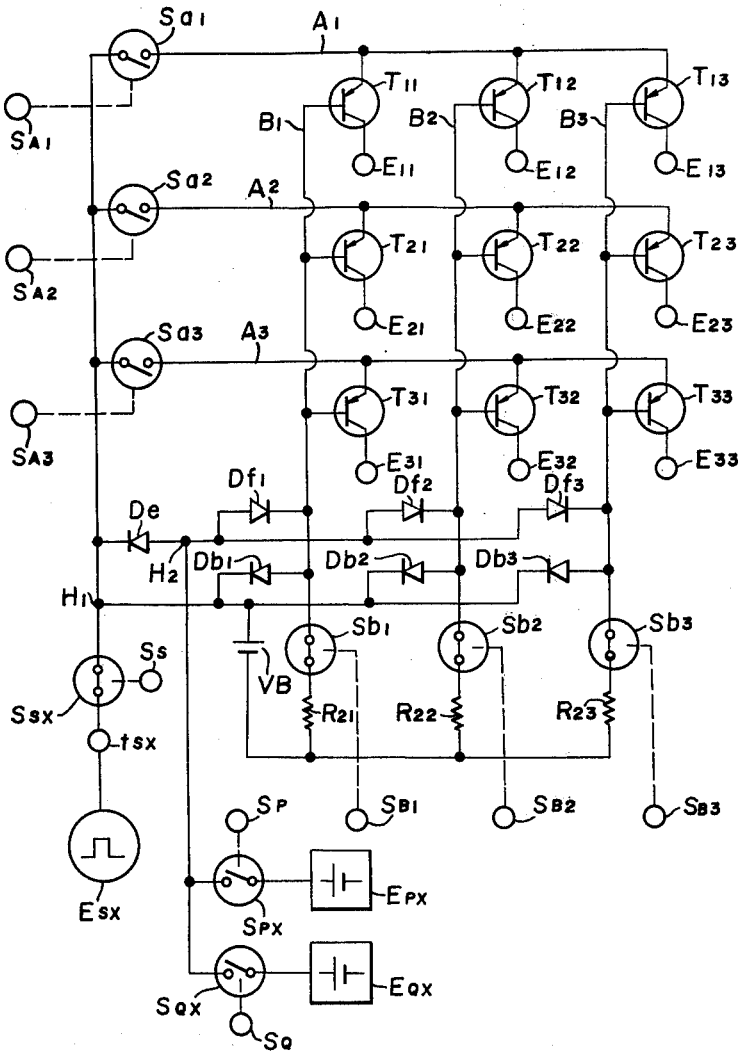

FIG. 16 shows a third embodiment of the X drive circuit (30X of FIG. 12) of the present invention. In this embodiment, the feed point $H_1$ for the sustaining drive voltage $V_{sx}$ and the feed point $H_2$ for the turn-on pulse $V_{px}$ and the turn-off pulse $V_{qx}$ are separately given. The feed point $H_1$ is directly connected to the selective switches $S_{a1}$ –$S_{a3}$ and is also connected through the diodes $D_{b1}$, $D_{b2}$, $D_{b3}$ to the electrical lines $B_1$, $B_2$, $B_3$. The feed point $H_2$ is connected through the diode $D_e$ to the selective switches $S_{a1}$ – $S_{a3}$, and is also connected through the diodes $D_{f1}$, $D_{f2}$, $D_{f3}$ to the electrical lines $B_1$, $B_2$, $B_3$. On the other hand, in this embodiment as in the embodiment of FIG. 14, the bias power source $V_B$ is provided, and the positive terminal of the bias voltage source $V_B$ is connected to the feed point $H_1$ and the negative terminal thereof is connected through the resistances $R_{21}$, $R_{22}$, $R_{23}$, to the selective switches $S_{b1}$, $S_{b2}$, $S_{b3}$. The bias voltage source $V_B$ can be used to bias all of the transistors in the ON state through the feed point H, the selective switches $S_{a1}$ –$S_{a3}$, the electrical lines $A_1$ – $A_3$, the emitters and bases of the transistors $T_{11}$ –$T_{33}$, the electrical lines $B_1$ – $B_3$, the selective switches $S_{b1}$ – $S_{b3}$ and the resistances $R_{21}$ – $R_{23}$. The control switches $S_{sx}$ and all of the selective switches $S_{a1}$ – $S_{a2}$, $S_{b1}$ – $S_{b3}$ are controlled to be in the ON state with regard to the application of the sustaining drive voltage $V_{sx}$, and as in the embodiment of FIG. 14, the sustaining drive voltage $V_{sx}$ is applied to the output terminals $E_{11}$ – $E_{33}$. The control switch $S_{sx}$ is turned off, and only the selective switch corresponding to the output terminal to which the pulse will be applied, is turned on by applying the turn-on pulse $V_{px}$ and the turn-off pulse $V_{qx}$. The characteristic of this embodiment is to apply the pulse through the diodes $D_{f1}$, $D_{f2}$, $D_{f3}$ to the electrical lines $B_1$ – $B_3$ by selectively applying the turn-on pulse $V_{px}$ and the turn-off pulse $V_{qx}$. For example, when the turn-on pulse $V_{px}$ is desirably applied to only the output terminal $E_{22}$, only the transistor $T_{22}$ is biased in the ON state by the bias voltage source $V_B$ by turning on the selective switches $S_{a2}$, $S_{b2}$. In this state, the turn-on pulse $V_{px}$ is applied through the diode $D_e$, the selective switch $S_{a2}$, to the electrical line $A_2$ and is also applied through the diodes $D_{f1}$, $D_{f2}$, $D_{f3}$ to the electrical lines $B_1$, $B_2$, $B_3$. At this time, the selective switches $S_{b1}$, $S_{b3}$ are in the OFF state. If the turn-on pulse $V_{px}$ is not applied to the electrical lines $B_1$, $B_3$ as stated above, then the potential of the electrical lines $B_1$, $B_3$ are unstable. When the turn-on pulse $V_{px}$ is applied to the electrical line $A_2$, the base current is passed through the transistors $T_{21}$, $T_{23}$, and the transistors $T_{21}$, $T_{23}$ can be accidentally turned on. This embodiment is to prevent such an unstable operation by applying the turn-on pulse and turn-off pulse also to the electrical lines $B_1$, $B_2$, $B_3$. In the former embodiment, when the turn-on pulse $V_{px}$ is applied to the output terminal $E_{22}$, the turn-on pulse $V_{px}$ is also applied to the electrical line $B_2$, and the transistor $T_{22}$ is in the ON state by the bias voltage source $V_e$, and accordingly the application of the turn-on pulse to the output terminal $E_2$ is maintained.

Figure 17:
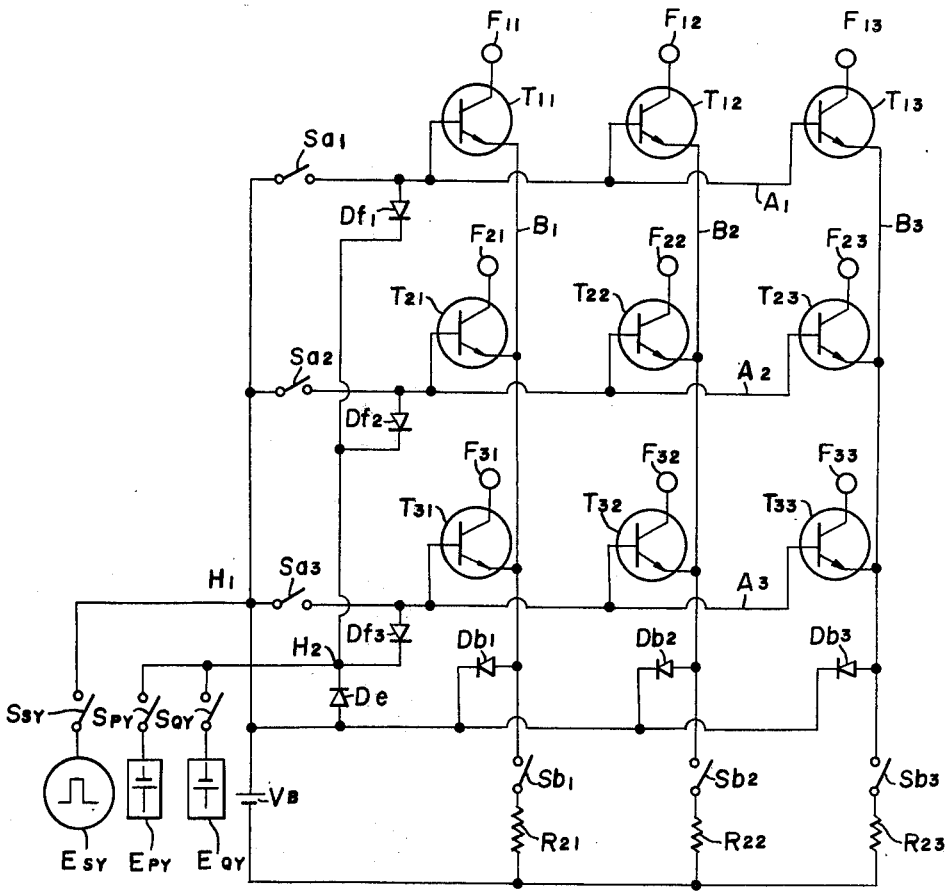
FIGS. 17 and 18 are respectively circuit diagrams for showing other embodiments of Y drive circuits according to the present invention.

FIG. 17 shows one preferred embodiment of a Y drive circuit (30 Y of FIG. 12) of the present invention which is used in the combination of the X drive circuits shown in FIGS. 14 – 16. In the Y drive circuit, (30 Y of FIG. 12) NPN transistors are used as the transistors $T_{11}$ – $T_{33}$. The bases of the transistors $T_{11}$ – $T_{13}$ are connected to the electrical line $A_1$, the bases of the transistors $T_{21}$ – $T_{23}$ are connected to the electrical line $A_2$ and the bases of the transistors $T_{31}$ –$T_{33}$ are connected to the electrical line $A_3$. The emitters of the transistors $T_{11}$, $T_{21}$, $T_{31}$ are connected to the electrical line $B_1$, the emitters of the transistors $T_{12}$, $T_{22}$, $T_{32}$ are connected to the electrical line $B_2$ and the emitters of the transistors $T_{13}$, $T_{23}$, $T_{33}$ are connected to the electrical line $B_3$. The collectors of the transistors $T_{11}$ – $T_{33}$ are respectively connected to the output terminals $F_{11}$ –$F_{33}$, and are respectively connected to the Y electrodes $Y_{11}$ –$Y_{33}$. The pulse voltage source $E_{sy}$ for applying the sustaining drive voltage $V_{sy}$ is connected through the selective switch $S_{sy}$ to the feed point $H_1$. The DC power source $E_{py}$ corresponding to the turn-on pulse $V_{py}$ and the DC power source $E_{qy}$ are respectively connected through the selective switches $S_{py}$, $S_{qy}$ to the feed point Hhd 2. The DC power sources $E_{py}$, $E_{qy}$ are connected of a polarity for applying a negative voltage to the feed point $H_2$. The feed point $H_1$ is directly connected to the selective switches $S_{a1}$, $S_{a2}$, $S_{a3}$, and is also connected through the diodes $D_{b1}$, $D_{b2}$, $D_{b3}$ to the electrical lines $B_1$, $B_2$, $B_3$. The feed point $H_2$ is connected through the diodes $D_{b1}$, $D_{b2}$, $D_{b3}$ to the electrical lines $B_1$, $B_2$, $B_3$, and is also connected through the diodes $D_{f1}$, $D_{f2}$, $D_{f3}$ to the electrical lines $A_1$, $A_2$, $A_3$. The positive terminal of the bias voltage source $V_B$ is connected to the feed point $H_1$ and the negative terminal thereof is connected through the resistances $R_{21}$, $R_{22}$, $R_{23}$ to the selective switches $S_{b1}$, $S_{b2}$, $S_{b3}$. The transistors are biased in the ON state, by the bias voltage source $V_B$ applied from the feed point $H_1$ through the selective switches $S_{a1}$ – $S_{a3}$, the electrical lines $A_1$ – $A_3$, the base-emitters of the transistors, the electrical lines $B_1$ – $B_3$, the selective switches $S_{b1}$ – $S_{b3}$ and the resistances $R_{21}$ –$R_{23}$. When the sustaining drive voltage $V_{sy}$ is applied, the control switch $S_{sy}$ and all of the selective switches are in the ON state. The pulse of the sustaining drive voltage $V_{sy}$ is applied to the feed point $H_1$ to provide a positive polarity, is applied through the selective switches $S_{a1}$ –$S_{a3}$ and the electrical lines $A_1$ –$A_3$ to the bases of the transistors and is further applied through the bases and collectors of the transistors to the collectors to the Y electrodes $Y_{11}$ –$Y_{33}$. In this case, the conductivity from the base to the collector of the transistors is effectively utilized. When the pulse is stopped and the pulse voltage source $E_{sy}$ is of a zero potential, the potential of the Y electrode is returned to zero potential by discharging through the collectors and emitters of the transistors in the ON state, the electrical lines $B_1$ – $B_3$, the diodes $D_{b1}$ – $D_{b3}$, the feed point $H_1$ and the control switch $S_{sy}$ to the pulse voltage source $E_{sy}$. When the turn-on pulse $V_{py}$ or the turn-off pulse $V_{qy}$ is applied, the control switches $S_{py}$ or $S_{qy}$ is controlled to be in the ON state, and the control switch $S_{sy}$ is controlled to be in the OFF state. In order to apply the pulse to the selected output terminal, the selective switches $S_{a1}$ –$S_{a3}$, $S_{b1}$ – $S_{b3}$ are selectively controlled to be in the ON state. When the turn-on pulse $V_{py}$ is applied to only the output terminal $F_{22}$, then only the selective switches $S_{a2}$, $S_{b2}$ are in the ON state, and only the transistor $T_{22}$ is biased in the ON state. The turn-on pulse is applied to the feed point $H_2$ to provide a negative polarity, and is applied through the diodes $D_e$, $D_{b2}$, the electrical lines $B_2$ and the collectors and emitters of the output terminals $T_{22}$ to the output terminals $T_{22}$ to the output terminals $F_{22}$, in a negative polarity. The pulse is applied through the diodes $D_{f1}$, $D_{f2}$, $D_{f3}$ to the electrical lines $A_1$ –$A_3$. In this manner an erroneous operation of turn-on by providing a negative base potential of the transistors $T_{12}$, $T_{13}$ is prevented.

Figure 18:
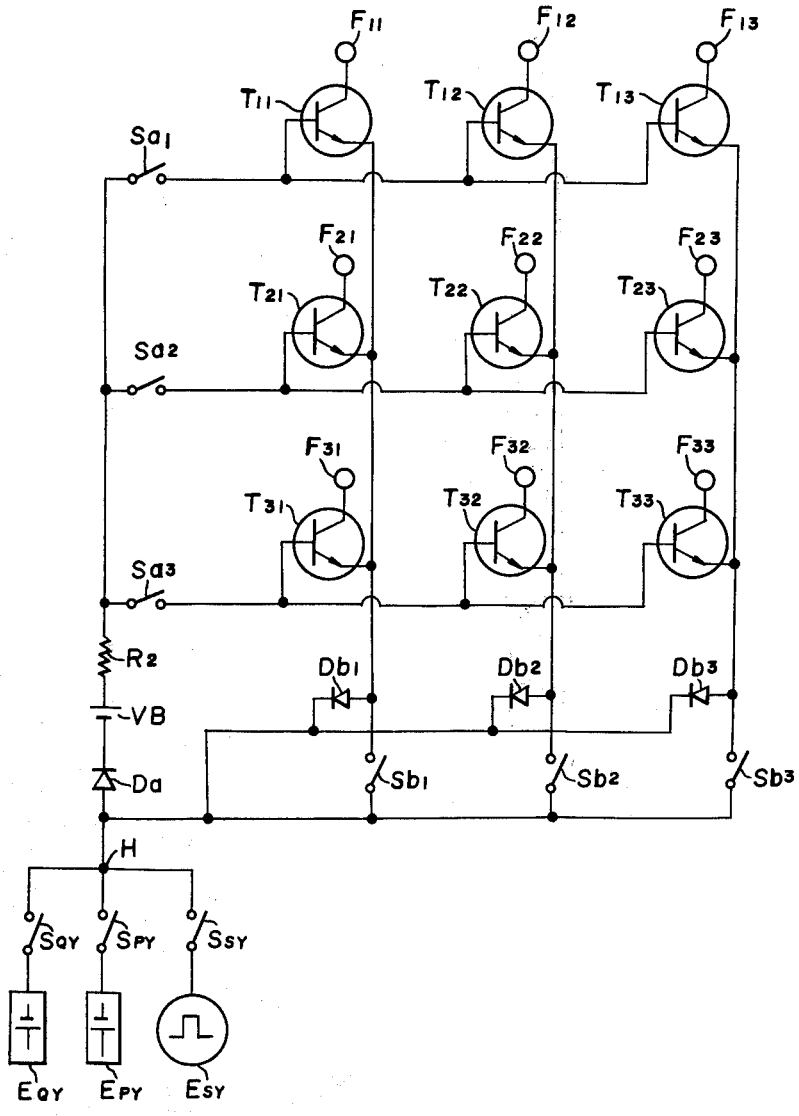

The embodiment of FIG. 17 is formed in a similar manner to that of FIG. 16. FIG. 18 shows Y drive circuit (based on the principle of FIG. 14). The operation of such an embodiment may be easily understood.

In accordance with the preferred embodiments of this invention, the bias circuit to the transistors through the first and second selective switches connected to the first and second electrical lines is formed, whereby the structure of the circuit can be simplified compared to the conventional circuits. With this invention, it should now be apparent that when the base bias current is passed through the bias circuit to the transistors by utilizing the sustaining drive voltage, a spscific bias voltage source can be omitted.

Also it should be apparent with the present invention that when the control pulse such as the turn-on pulse and the turn-off pulse for controlling the discharge is applied through one of the first or second selective switches to only one of the first and second electrical lines, an erroneous operation for applying the control pulse to an unnecessary electrode can be prevented.

Obviously, numerous modifications and variations of the present invention are possible in light of the above teachings. It is therefore to be understood that within the scope of the appended claims the invention may be practiced otherwise than as specifically described herein.

What is claimed as new and desired to be secured by Letters Patent of the United States is:

1. An AC drive discharge type display apparatus which comprises:

a discharge type display panel having a plurality of electrodes, a drive circuit for the electrodes comprising:

a plurality of transistors T11, T12, T13, T21, T22, T23, T31, T32 and T33, a plurality of switches S*a*1, S*a*2, S*a*3, S*p*, S*s*, S*b*1, S*b*2 and S*b*3, a plurality of diodes D*a*1, D*a*2, D*a*3, D*b*1, D*b*2 and D*b*3, a plurality of resistors R1*a*, R1*b*, R1*c*, R2*a*, R2*b* and R2*c*, a turn-on pulse terminal V*p*, a sustaining drive voltage terminal V*s*, means connecting V*p* through S*p* and S*a*1 to the emitters of T11, T12 and T13, means connecting V*p* through S*p* and S*a*2 to the emitters of T21, T22 and T23, means connecting V*p* through S*p* and S*a*3 to the emitters of T31, T32 and T33, means connecting V*s* to the emitters of T11, T12 and T13 through D*a*1, to the emitters of T21, T22 and T23 through D*a*2 and to the emitters of T31, T32 and T33 through D*a*3, means commonly connecting the bases of transistors T11, T21 and T31 to S*s* through a parallel connection of R1*a* and D*b*1, means commonly connecting the bases of transistors T12, T22 and T32 to S*s* through a parallel connection of R1*b* and D*b*2, means commonly connecting the bases of transistors T13, T23 and T33 to S*s* through a parallel connection of R1*c* and D*b*3, means connecting the bases of T11, T21 and T31 to S*b*1 through R2*a*, means connecting the bases of T12, T22 and T32 to S*b*2 through R2*b*, means connecting the bases of T13, T23 and T33 to S*b*3 through R2*c*, means commonly connecting S*b*1, S*b*2 and S*b*3, an output terminal E11 connected to the collector of T11, an output terminal E12 connected to the collector of T12, an output terminal E13 connected to the collector of T13, an output terminal E21 connected to the collector of T21, an output terminal E22 connected to the collector of T22, an output terminal E23 connected to the collector of T23, an output terminal E31 connected to the collector of T31, an output terminal E32 connected to the collector of T32, and an output terminal E33 connected to the collector of T33.

2. An AC drive type display apparatus which comprises:

a discharge type panel having a plurality of electrodes, a drive circuit for the electrodes comprising:

a plurality of transistors T11, T12, T13, T21, T22, T23, T31, T32 and T33, a plurality of diodes D*a*1, D*a*2, D*a*3 and D*b*, a resistor $R_2$, a plurality of switches S*a*1, S*a*2, S*a*3, S*b*1, S*b*2, S*b*3, SQX, SPX and SSX, a first turn off pulse EQX, a second turn off pulse EPX, a sustaining drive voltage ESX, a bias voltage source VB, means connecting EQX to a first terminal of D*b* through SQX, means connecting EPX to the first terminal of D*b* through SPX, means connecting ESX to the first terminal of D*b* through SSX, means connecting a second terminal of D*b* of the bases of T11, T21 and T31 through S*b*1, to the bases of T12, T22 and T32 through S*b*2 and to the bases of T13, T23 and T33 through S*b*3, means connecting the first terminal of D*b* to the emitters of T11, T12 and T13 through D*a*1, to the emitters of T21, T22 and T23 through D*a*2 and to the emitters of T31, T32 and T33 through D*a*3, means connecting the first terminal of D*b* to a first terminal of VB, means connecting a second terminal of VB to the emitters of T11, T12 and T13 through R2 and S*a*1, to the emitters of T21, T22 and T33 through R2 and S*a*2 and to the emitters of T31, T32 and T33 through R2 and S*a*3, means connecting an output terminal E11 to the collector of T11, means connecting an output terminal E12 to the collector of T12, means connecting an output terminal E13 to the collector of T13, means connecting an output terminal E21 to the collector T21, means connecting an output terminal E22 to the collector of T22, means connecting an ouput terminal E23 to the collector of T23, means connecting an output terminal E31 to the collector of T31, means connecting an output terminal E32 to the collector of T32, and means connecting an output terminal E33 to the collector of T33.

* * * * *